United States Patent [19]

Meininger

[11] 4,040,399

[45] Aug. 9, 1977

[54] BACK DRAFT CARBURETOR FOR TWO CYCLE ENGINES

[75] Inventor: James R. Meininger, Fond du Lac, Wis.

[73] Assignee: Brunswick Corporation, Skokie, Ill.

[21] Appl. No.: 585,864

[22] Filed: June 11, 1975

[51] Int. Cl.[2] ..... F02M 5/08

[52] U.S. Cl. ..... 123/65 R; 261/72 R; 261/DIG. 67

[58] Field of Search ..... 123/65 R; 261/DIG. 67, 261/DIG. 68, 72 R, 73, 65 R

[56] References Cited

U.S. PATENT DOCUMENTS

| | | | |
|---|---|---|---|
| 1,505,565 | 8/1924 | Johnson | 261/DIG. 67 X |
| 1,620,827 | 3/1927 | Mock et al. | 261/DIG. 67 X |
| 1,740,917 | 12/1929 | Beck | 261/DIG. 67 X |
| 1,785,681 | 12/1930 | Goudard | 261/DIG. 67 X |
| 1,799,585 | 4/1931 | Ensign | 261/72 R |
| 1,805,763 | 5/1931 | Ensign | 261/72 R |
| 2,023,647 | 12/1935 | Schmid | 261/DIG. 67 X |
| 2,029,142 | 1/1936 | Wemhoner | 261/DIG. 67 X |
| 2,750,171 | 6/1956 | Udale | 261/DIG. 67 X |
| 2,752,136 | 6/1956 | Gardner | 261/DIG. 67 X |
| 2,906,251 | 9/1959 | Soder, Jr. | 123/117 R X |
| 3,037,751 | 6/1962 | Phillips | 261/DIG. 68 X |

*Primary Examiner*—Carroll B. Dority, Jr.
*Assistant Examiner*—Tony M. Argenbright
*Attorney, Agent, or Firm*—Lewis L. Lloyd

[57] ABSTRACT

Vacuum, created by venturi effect of the throttle valve within the throat of a carburetor of a two cycle outboard motor, in company with a vacuum source orifice positioned opposite a peripheral edge of the throttle valve, is partially applied, by strategic placement of a vacuum source hole, to the fuel float chamber of the carburetor to reduce fuel flow over a selected range of engine RPM; normally when the boat it is driving is cruising on plane. A changeable vent to atmosphere is used to adjust the vacuum level to compensate for altitude changes and to adjust the carburetor to a particular motor. An expansion chamber in the vacuum source line may be required to prevent engine hesitation upon acceleration.

14 Claims, 9 Drawing Figures

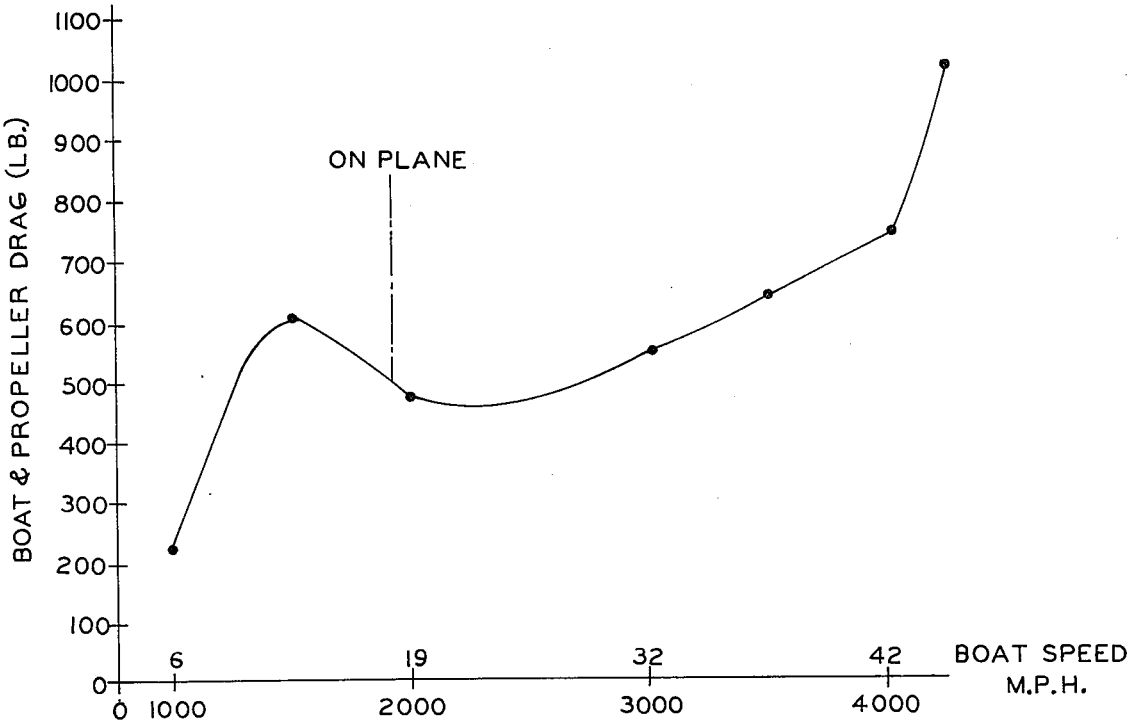
Fig. 1
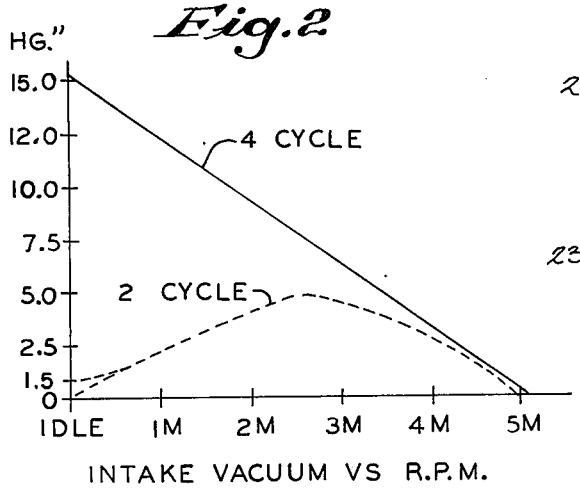
Fig. 2
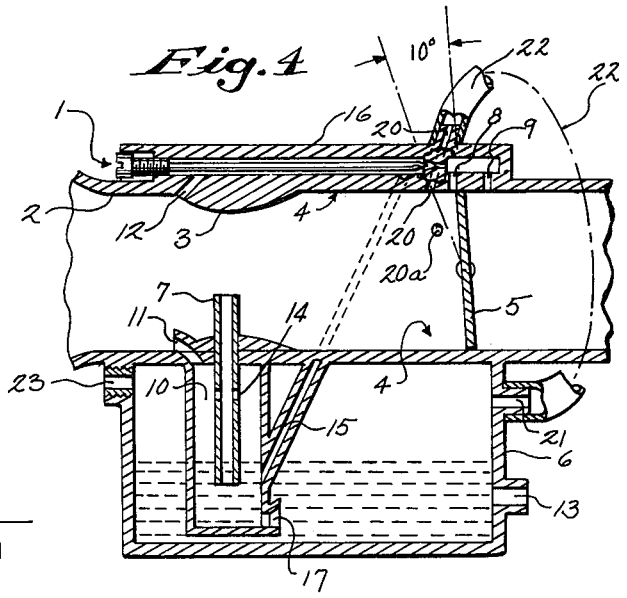
Fig. 4
Fig. 3
| | IDLE TO 800 R.P.M. | 800 TO 2500 R.P.M. | 2500 TO FULL |
|---|---|---|---|
| SPARK – | 5° ATDC TO TDC | TDC TO 25° BTDC | STEAD 25° BTDC |
| THROTTLE– | CLOSED | 0 TO 20° | 20° TO FULL OPEN |

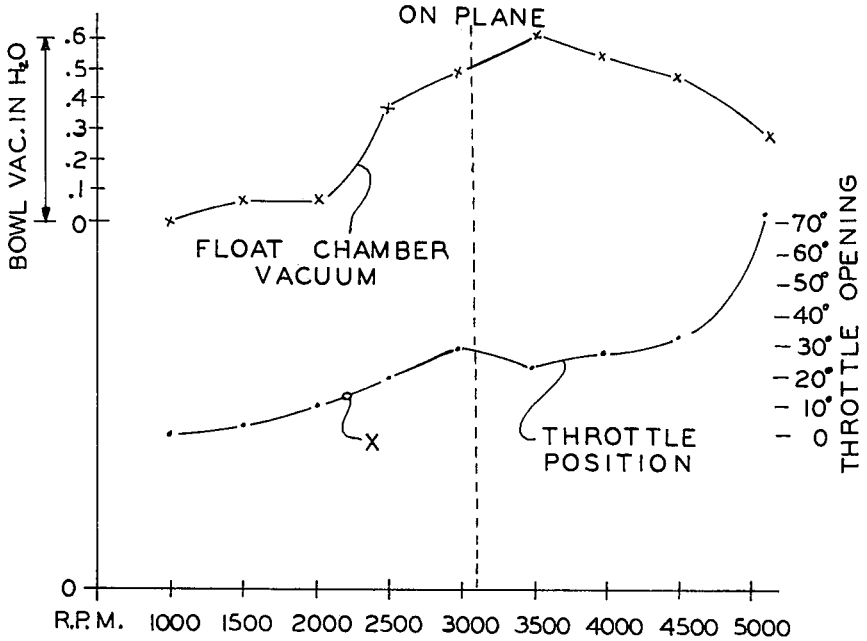
Fig. 5
Fig. 8
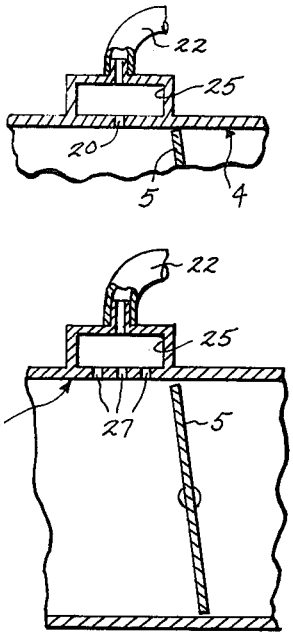
Fig. 9
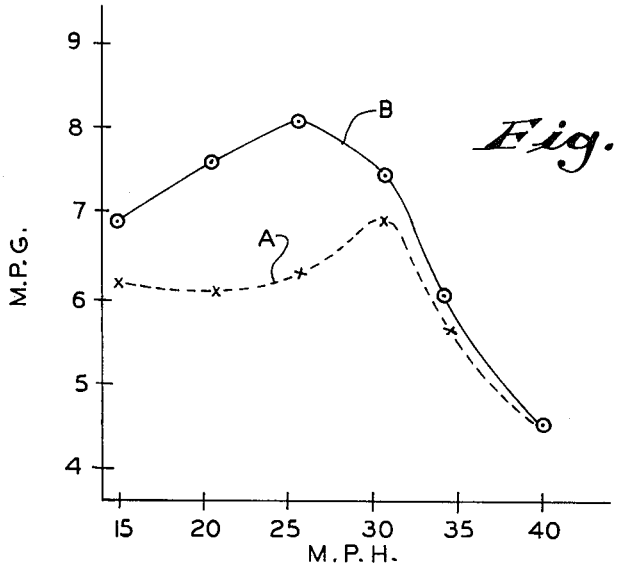
Fig. 6
| R.P.M. | WITHOUT BACK DRAG M.P.H. | G.P.H. | M.P.G. | WITH BACK DRAG M.P.H. | G.P.H. | M.P.G. |
|---|---|---|---|---|---|---|
| 5100 | 39.7 | 8.82 | 4.5 | 39.9 | 8.72 | 4.57 |
| 4500 | 34.5 | 6.09 | 5.67 | 34.2 | 5.65 | 6.05 |
| 4000 | 30.55 | 4.48 | 6.82 | 30.7 | 4.12 | 7.45 |
| 3500 | 25.7 | 4.04 | 6.37 | 25.8 | 3.21 | 8.05 |
| 3000 | 20.65 | 3.41 | 6.05 | 20.6 | 2.74 | 7.53 |
| 2500 | 15.05 | 2.44 | 6.17 | 15.05 | 2.23 | 6.75 |
Fig. 7

BACK DRAFT CARBURETOR FOR TWO CYCLE ENGINES

BACKGROUND OF THE INVENTION

The invention is in the field of carburetors for two stroke or two cycle engines, with particular application to outboard motors. Reducing pressure in the float bowl of the carburetor of a four cycle engine has been disclosed in U.S. Pat. Nos. 1,799,585, 1,805,763, 1,785,681, 2,029,142, 2,752,136, 1,851,711, and 1,740,917, with the first two patents listed being considered most pertinent. However, the concept has not, to the inventor's knowledge, ever before been applied to two cycle engines and particularly not to outboard motors.

Applying the broad concept to two stroke or two cycle engines as herein taught, presented special problems. First, while air pressure is lowest (greatest vacuum) in the intake manifold of a four cycle engine at idle and low RPM and increases with increased RPM, pressure in the crankcase of a two cycle engine is highest (close to atmospheric) at idle, and generally decreases to a low point somewhere in midrange RPM and then increases as RPM further increases, see FIG. 2. Furthermore, the vacuum in the carburetor throat of a two cycle engine is normally much less than half the vacuum in the intake manifold of the four cycle engine at relatively low speeds. See FIG. 2.

The prior art employed the aforementioned low pressure (vacuum) existing in the manifold of the four cycle engine to reduce the pressure in the float bowl. However, to apply the broad theory manifested in the prior art patents to two cycle outboard motors, the inventor had to solve two basic problems. First, compensate for the lower vacuum of the two cycle engine by somehow creating a regulating vacuum at low RPM, and second, program the application of vacuum to the float bowl in a manner so as to take advantage of its economizing effect without adversely effecting the performance of the motor when used to drive a boat. A mating of the knowledge of 2 cycle outboard motor performance and boat hull characteristics was required to achieve the invention.

While the drag of an automobile and a displacement type boat hull increases with speed, the drag on a planing type boat hull increases rapidly when starting up and then decreases for a period when the hull starts to plane upon the water before increasing again as speed is increased. See FIG. 1. It is common practice to use high or full power to get the hull "on plane" and then reduce throttle and travel in the low draw region for the hull, or best cruise range. Experiments have taught that most planing hulls of 16' to 20', average for a recreational boat, achieve the planing condition at speeds of between 15 to 20 miles per hour. Experiments have also taught that when outboard motors are provided with propellers that permit them to run at desired maximum RPM when propelling particular boats, that the RPM required to maintain these boats on plane in the cruising speed range is about the same, and that the corresponding throttle settings (positions of throttle valves in the carburetor throats) will not vary greatly for a particular engine used on different sized boats, if it has been "propped" to achieve full RPM on the particular boat.

Earlier attempts to achieve greater economy in outboard engines led to the development of what has been called the economizer linkage. Broadly, this linkage provides a variable mechanical link between the throttle and spark to provide optimum spark advance for each throttle opening over the full range of engine RPM. A typical profile of throttle and spark settings required for the full RPM range of a representative 150 HP outboard motor is illustrated in FIG. 3. Note that the early increase in RPM results from spark balance alone, the midrange increase from advance of throttle and spark, and advance to high power from opening throttle alone. This limited throttle movement has been found to play a part in the invention.

Until the invention, success in efforts to make outboard motors run on less fuel effectively terminated with the economizer linkage. If it was known that such engines were running rich at cruising speeds, little had been done about it, and it remained for the inventor, based upon his 18 years experience as a carburetor engineer, to conceive of a way to employ the back draft concept illustrated in the 44 year old art cited above on an outboard motor equipped with the economizer linkage and achieve the material improvement in economy illustrated herein.

The invention sprang from the discovery, through testing under operating conditions, that an outboard motor carburetor configured to give good wide open throttle, idle and acceleration performance and operated by an economizer linkage with the spark, provided an unnecessarily rich mixture over the intermediate throttle range e.g. 12° to 30° throttle valve opening. Although the economizer linkage achieved the best throttle/spark relationship for maximum RPM at all throttle settings, the invention achieves a further leaning for greater economy.

The primary objective of the invention is to reduce fuel consumption of 2 cycle engines and outboard motors in particular, and to do so without sacrifice of full power, acceleration or idle performance of the engine, and to accomplish the above in the simplest and most economical manner.

Further objectives of the invention were to provide means for adapting the system of the invention for operation at various altitudes, and to provide a carburetor incorporating the system with means to permit its adaption for use on engines of different horsepower and design.

SUMMARY OF THE INVENTION

Basically, the invention comprises a float bowl type carburetor of known design for a two cycle engine wherein the improvement comprises a vacuum source comprising a hole in the carburetor throat positioned adjacent to the edge of the throttle valve at a preselected throttle valve opening, a passage connecting said vacuum source with the air space above the fuel in the float bowl of the carburetor, and means for venting the same air space to the atmosphere, whereby pressure in the float bowl of the carburetor is reduced resulting in reduced fuel flow over a selected range of engine RPM.

The invention has resulted in very substantial economy in the operation of outboard motors to which it has been applied. Compared with the same carburetor on the same engine on the same boat, before and after incorporation of the invention, FIG. 7 shows that over the mid-range RPM where the invention was designed to be effective, a substantial reduction in fuel consumed (gallons per hour) is achieved at no reduction in boat speed; and that a very substantial increase in miles traveled per gallon of fuel used is realized. See FIG. 6.

DESCRIPTION OF THE DRAWINGS

FIG. 1 is a plot of the drag of a typical planing type boat hull vs. speed, resulting from an operational study of an 18 foot Cobia boat.

FIG. 2 is a comparison of crankcase and intake manifold vacuum pressures, respectively, of 2 and 4 cycle internal combustion engines over the idle to full RPM range of the respective engines.

FIG. 3 is a table illustrating the movement of the spark throttle valve over the full range of RPM of a current 150 HP outboard motor incorporating an economizer linkage.

FIG. 4 is a cross-sectional schematic illustration of the invention as applied to a typical carburetor for a 2 cycle outboard motor.

FIG. 5 is a graph of the vacuum above the fuel in the flot bowl of the carburetor such as that illustrated in FIG. 4, and matching throttle settings over a range of 1,000 to 5,000 RPM for a 50 HP outboard motor when driving a 16 foot planing type boat.

FIG. 6 is a graph showing the increase in miles per gallon achieved by an 85 HP outboard motor incorporating the invention in driving an 18 foot planing type boat at cruising speeds.

FIG. 7 is a table comparing performance of the engine and boat combination of FIG. 6 with and without the system of the invention.

FIG. 8 is a schematic illustration of a modification of the invention useful under described circumstances.

FIG. 9 is a schematic illustration of an alternate configuration of the invention.

DETAILED DESCRIPTION OF THE DRAWINGS

FIG. 1 illustrates the variation in drag of a typical planing type boat hull on which most outboard motors of 20 HP and above are used. The invention is normally most effective when employed on outboard motors so utilized. Such a hull has minimum drag at speeds which may be held by midrange RPM of its outboard power, provided the hull is adequately powered. In this speed range the engine will be fairly lightly loaded and therefore most amenable to a leaning of its fuel/air mixture. Leaning is not ordinarily desired at engine RPM below that at which planing is achieved, as in that area the engine will be fairly heavily loaded and a rich or "power" mixture desirable. Equally important is the fact that leaning is not desired at high engine RPM or during acceleration. As will be seen, the invention does not lean the mixture at idle, high throttle settings or during acceleration at high throttle settings.

FIG. 2 is a comparison of the intake (manifold) pressure of a four cycle engine to the intake (crankcase) pressure of a two cycle outboard motor. In considering the prior art, the difference between these two values is significant. The low vacuum (relatively high pressure) in the 2 cycle crankcase at low RPM renders the prior art devices ineffective in their application to 2 cycle engines.

FIG. 3 is a table showing typical throttle and spark settings of an outboard motor employing the economizng linkage described above to achieve the RPM indicated. By reviewing the data contained in FIGS. 1, 2, and 3, one can obtain an indication of the range of throttle settings over which the leaning effect of the invention may best be applied; a prerequisite for the positioning of the vacuum source hole with respect to the throttle valve as will be explained.

FIG. 4 is a schematic of a typical carburetor for an outboard motor, with the back draft system of the invention installed. The basic carburetor 1 includes an intake 2, a venturi 3, a throat 4, a throttle valve 5, a fuel float bowl 6, a main nozzle 7, idle fuel jets 8 and 9, a fuel well 10 in the float bowl, an accelerating air inlet 11, an idle air inlet 12, and a fuel inlet 13 to the float bowl 6. An accelerating air inlet 11 leads to the fuel well 10 and mixes with the fuel through ports 14 in the body of the main nozzle 7. Idle fuel is drawn from the fuel well 10 through an idle fuel line 15, and idle air from the port 12 joins the fuel line 15 in the body of a needle valve 18 which is used to adjust idle fuel flow. Fuel is supplied to the well 10 through an inlet 17. All of the above are elements known to the art as here employed and are not a part of the invention.

Basically, the invention comprises a vacuum source hole 20 strategically sized and placed in the throat 4 of the carburetor 1; a sized vacuum inlet orifice 21 to the float bowl 6 communicating with the air space above the fuel therein; a passage 22 connecting the source hole 20 and inlet 21, and a sized orifice 23 venting the air space above the fuel in the float bowl to the atmosphere.

Outboard motor carburetors are ideally designed to permit rapid acceleration from any RPM between idle to full RPM. This has been achieved through the use of such known devices as boost venturis and air bleed to get fuel to the engine as required for acceleration. The inventor discovered that at any part throttle setting where the main fuel jet of such a carburetor is fully operative (idle jet no longer has any control over engine speed) the mixture can be leaned about 15% to 20%. Thus, one of the criteria for positioning of the vacuum source hole of the invention is the opening (in degrees) of the throttle valve of the carburetor at the point where the main jet is fully cut in so that the idle jets no longer control engine speed. Another criteria is the lowest throttle setting from which the engine will rapidly accelerate upon the quick opening of the throttle to the full open position. In practice, however, it is ordinarily not desirable to start leaning at either of these low RPMs because the average boat the motor would be pushing would not yet be on plane and therefore a rich power mixture would still be desirable.

The vacuum source hole 20 is ideally placed immediately opposite the edge of the throttle valve 5 when the valve 5 is positioned by the economizer linkage to produce the RPM calculated to be at least sufficient to hold the average boat on which the engine would likely be used on plane, normally at the low end of its cruising speed range. Experience indicates that this throttle setting will vary from engine to engine from as low as 5° to as high as 30°, with the average setting being around 10° to 12° producing 2,000 to 2,500 RPM.

Referring again to FIG. 2, it can be seen that vacuum in the throat 4 at the aforementioned RPM is only about 2.5 inches high. Consequently, the primary consideration for placement of the hole is to take advantage of the isolated venturi effect created by the presence of the edge of the throttle valve 5 immediately over the vacuum source hole 20. FIG. 5 shows the vacuum in the air space above the fuel in the float chamber 6 at various throttle positions for a 50 HP motor equipped with economizer linkage and the invention, and illustrates that as the throttle valve approaches and crosses the position X of the source hole 20 there is a rapid increase in the vacuum in the float chamber 6. Since movement of the throttle plate through the midrange RPM of this engine is relatively small — only 18° between 2,000 and 4,100 RPM the throttle plate will remain relatively close to the vacuum source hole 20 so that its influence on the pressure in the float bowl is prolonged. Realization that the venturi effect of the throttle plate near the vacuum source hole could be used and was needed to make the back draft concept work on a 2 cycle engine, and that there was limited movement of the throttle valve of an outboard motor equipped with the economizer linkage through the RPM range where fuel economy was possible, were primary factors contributing to the invention.

An unexpected result occurred where it was found that a single vacuum source hole positioned to commence leaning at a low midrange RPM would also achieve the leaning effect desired over an extended midrange RPM; so that a single hole was sufficient in most instances. Apparently, the increased air flow through the back draft system as herein described is sufficient at higher midrange RPM of a 2 cycle engine to maintain and even increase the vacuum in the float bowl until both (a) the throttle valve has moved substantially away from the vacuum source hole, and (b) the intake vacuum in the crankcase of the engine has diminished, at which point the system becomes ineffective and a power mixture is again made available for high power settings.

Further with respect to placement of the vacuum source hole 20, the hole 20 may be positioned with respect to the throttle valve plate 5 so as to lie on a plane perpendicular to and bisecting the throttle plate axis of rotation, or the hole 20 may be moved up the side of the throat 4 to a point 20*a* closer to the axis of rotation of the throttle valve. As the throttle plate will move more slowly over the hole 20*a* when placed in the latter position, it is anticipated that the range of effectiveness of the back draft upon the float bowl can be controlled and prolonged in this manner.

The diameter of the vacuum source hole 20 is ideally small, around 0.040 inch, primarily in order to keep the other associated orifices in the system small. The diameter of the vacuum inlet 21 to the float bowl should be somewhat less than twice that of hole 20, and the diameter of the vent to atmosphere is ordinarily somewhat greater than twice the diameter of the source hole 21. For example, for an 85 HP outboard motor having a vacuum source hole 20, diameter of 0.040 inch, the desirable diameter of the inlet 21 is 0.0785 inch and of the vent 23 is 0.092 inch. The diameter of the passage 22 is not critical but should not be smaller than that of the fittings it connects.

The diameter of inlet 21 can be used, by reducing it in size relative to the vent 20, to help delay and thereby dampen the effect of any transitory vacuum pulses created as the throttle valve passes rapidly over the vacuum source hole 20.

A primary advantage of the invention as applied to a particular carburetor is the ability to vary the size of the vent 23 to atmosphere and thereby adapt that carburetor to a different engine or the same engine to different altitudes of operation. The vent 23 is ideally constructed as a removable threaded plug-like element, similar to a fuel "jet," which may be threaded into a prepared aperture in the float bowl. Several such elements should be made available, each having a different sized orifice therein to adapt the carburetor to operating condition, or the vent can have a variable opening similar to a needle valve. For example, the vent 23 would be made larger when operating at higher altitudes to compensate for the effect of reduced density of the air on the system, and the vent 23 made larger or smaller depending upon the fuel needs of the particular engine the carburetor is used upon. Ideally a carburetor should be matched to a particular engine, but in some instances the needs of different engines are close enough to enable matching by merely changing the vent plug 23.

The ratios of the areas of source hole 20 to vent 23 in square inches may range from 1:5 to 1:5.5 depending upon carburetor and engine design, the character of the work load upon the engine and the altitude at which the engine is operating.

After placing the vacuum source hole to achieve the back draft effect over the desired range of cruising RPM, to most effectively employ the invention, it is desirable to determine, experimentally, for a particular outboard motor, mounted on a planing type hull of a size reasonably related to the engine horsepower and with the engine propped for desired maximum RPM, the fuel flow for each throttle setting that provides the maximum miles traveled per unit of fuel burned. Fuel flow at each throttle setting can easily be determined by known test methods, and miles per gallon determined by dividing boat travel (in miles) over a measured course by the fuel consumed (in gallons) over the course. Once fuel flow for maximum miles per gallon over the cruising range of throttle settings has been determined, starting with a vent 23 twice the diameter of the source hole 20, adjustments in the size of the vent 23 are made to cause the carburetor to most nearly provide the desired fuel flow over the range of throttle settings (RPM) selected.

Note that the leaning effect of the invention is not present at engine idle, as there is virtually no vacuum at the source hole 20 in the carburetor throat at idle RPM. Note also that when the throttle valve is opened wide, as in full power or for acceleration, the throttle valve will not be in the vacinity of the source hole 20. Consequently no special venturi effect will be created and the only remaining back draft effect will be that due to the vacuum in the carburetor throat which has been found to have no noticeable effect upon engine operation at high RPM.

FIG. 6 illustrates the impressive increase in miles per gallon achieved by the system of the invention over the cruising speed range of a Mercury 85 HP engine when driving an 18 foot Sidewinder boat. Line A represents miles per gallon of the engine before adding the invention to its carburetor, and line B represents miles per gallon achieved by the same engine with the same carburetor after adding the invention.

FIG. 7 further illustrates that for a given engine RPM incorporation of the invention (a) cuts fuel consumption and, (b) increases miles traveled per gallon, at no sacrifice of boat speed.

FIG. 8 is a schematic of a modifiction of the invention found to be helpful when the line 22 connecting the vacuum source hole 20 and inlet 21 is short. When the line 22 is short, engine hesistation has been experienced during acceleration when the throttle is advanced to achieve a high power setting. The hesistation is cause by a transitory back draft effect on the carburetor as the throtle valve passes over the vacuum source hole 20. This problem is eliminated by incorporating an expansion chamber 25 either adjacent the hole 20, by casting it in the carburetor body, or providing for it somewhere in the line 22. The chamber 25 functions to damp the unwanted transitory pulse while not effecting the steady state operation of the system. Size of the chamber is not critical; however, a cylindrical chamber having a diameter of 0.5 inch and a depth of 0.012 inch has been found to function satisfactorily on a carburetor for an 85 HP outboard motor having the line 22 incorporated in the body of the carburetor.

FIG. 9 is a schematic of an embodiment version of the invention incorporating a series of vacuum source holes 27, similar to hole 20 aligned axially along the throat 4 of the carburetor. The effect of these additional holes is to take further advantage of the venturi formed between the edge of the throttle valve 5 and the throat 4 of the carburetor, and thereby increase the back draft effect over a broader range of throttle movement. The number and location of such holes is best determined by trial on a particular engine/carburetor combination.

While the precise dimension of the elements of the invention must be determined for each engine by the methods and criteria set forth above, the following is a specific example of how the invention has been successfully employed. The carburetor of a stock 1974 model of a Mercury 85 HP motor was modified to incorporate the invention as follows. A source hole 0.040 inch in diameter was drilled in through the carburetor body at a point 10° in front of the throttle valve plate i.e. so the hole would be immediately opposite the edge of the plate when it was open 10°. A fitting with an I.D. of 0.0785 inch was attached to the top of the float bowl in communication with the air space above the fuel. A small bore rubber tube connected the 0.040 inch source hole and the 0.0785 inch fitting. A removable vent jet having an I.D. of 0.092 inch was threaded into a fitting on the float bowl providing the float chamber with a 0.092 inch vent to the atmosphere. The improvements in operating economy of the engine when driving an 18 foot Sidewinder boat are illustrated by FIGS. 6 and 7.

While the foregoing discussion and examples of the invention are directed to outboard motors, no limitation of the invention to that field should be implied as the invention has broad potential in the field of 2 cycle engines in general.

I claim:

1. In a carburetor for a two stroke engine including a body, float bowl fuel chamber, a main fuel supply system including a main fuel nozzle and an idle fuel supply system including an idle fuel jet, each system communicating with a bottom portion of said float bowl, an air intake, a venturi, a throat section downstream of said venturi, and a throttle plate-type valve rotationally mounted in the throat; a back draft fuel economizing means comprising; means opening into the carburetor throat and responsive to the proximity of the throttle valve for creating a vacuum source, passage means for connecting said means for creating a vacuum with the air space above the fuel in said float bowl, and means for venting one of said passage means and float bowl to the atmosphere to limit the effect of said vacuum upon said float chamber, said means for creating a vacuum source comprising an orifice positioned substantially upstream of the throttle valve plate when said valve plate is positioned for idle and opening into the carburetor throat at a preselected point directly opposite a peripheral edge of the throttle valve plate when said throttle valve is sufficiently open to inactivate said idle fuel supply system and render the main fuel supply system fully operative and is further positioned to provide a selected minimum cruising RPM of the engine, said orifice and valve plate utilizing the venturi effect therebetween to create said vacuum.

2. The device of claim 1 wherein the throttle opening which places the edge of the throttle valve over the vacuum source orifice is that opening required for the engine to maintain minimum RPM from which it will accelerate to full RPM upon the rapin application of throttle to the wide open position.

3. The device of claim 1 wherein the ratio of the area of the vacuum source orifice to the area of the vent to atmosphere is between 1:5 and 1:5.5.

4. The device of claim 1 wherein said passage means communicates exclusively with said vacuum source orifice and the air space above the fuel in the float bowl.

5. The device of claim 1 further including means for providing a restricting orifice in the passage connecting said vacuum source and said float bowl, said orifice being larger than the vacuum source orifice in said carburetor throat and smaller than said vent to atmosphere whereby the effect of transitory pressure changes at the vacuum source orifice upon the pressure within the float bowl fuel chamber is diminished.

6. The device of claim 1 furthter including means comprising an enlargement in said passage means connecting the vacuum source orifice to the air space above the fuel in the float bowl fuel chamber for dampening transitory pressure changes within said passage produced by rapid passage of the throttle valve over said vacuum source orifice.

7. The device of claim 1 wherein said vacuum source means comprises a plurality of orifices arranged axially within the carburetor throat so as to be directly opposite the peripheral edge of the throttle valve at different open positions of said valve.

8. The device of claim 1 wherein said vacuum source orifice is positioned in the carburetor throat in a plane bisecting and perpendicular to the axis of rotation of the throttle valve.

9. The device of claim 1 wherein said vacuum source orifice is positioned in the carburetor throat apart from a plane bisecting and perpendicular to the axis of rotation of the throttle valve.

10. In a method of adjusting fuel flow through the carburetor of a two cycle outboard motor equipped with a back draft economizer system including a vacuum source orifice, a fuel float bowl and an atmospheric vent from the space above the fuel in the fuel float bowl to achieve greater economy over a selected range of motor speeds, the steps comprising a. attaching the outboard motor to a boat hull
b. determining for incremental throttle settings over a selected RPM range the fuel flow required to achieve maximum miles traveled by said boat per gallon of fuel consumed, and
c. adjusting the size of the vent to atmosphere in the back draft economizer system in relation to the size of the vacuum source orifice to most nearly achieve the desired fuel flow determined as required in step (b).

11. In a method of calibrating a carburetor of an outboard motor equipped with a back draft economizer system including a vacuum source orifice, a fuel float bowl and an atmospheric vent from the space above the fuel in the fuel float bowl for improved economy of operation of said motor on a boat the steps comprising a. selecting a range of RPM of operation of the motor at which the main fuel nozzle is fully operating and over which a less than full power fuel mixture is desirable b. determining the throttle valve setting required to maintain the minimum RPM of said range, c. placing the vacuum source orifice of said back draft economizer system under the peripheral edge of said throttle valve when said throttle valve is positioned to maintain said minimum RPM d. determining for incremental throttle valve settings over said selected RPM range the minimum fuel flow required to drive said boat over a measured course in the shortest time, and e. adjusting the size of a vent to atmosphere in said back draft system of said carburetor to most nearly achieve the said minimum fuel flows required over the effective range of said back draft economizer system.

12. A method of determining the position of the vacuum creating orifice in the throat of a carburetor including a vacuum source orifice, a fuel float bowl and an atmospheric vent from the space above the fuel in the fuel float bowl for operation on an outboard motor propelling a particular boat, and calibrating said carburetor for maximum miles per gallon operation of said motor on said boat, comprising the steps of:

a. determining the range of throttle valve openings and consequent motor speeds (RPM) over which a leaning of the fuel/air mixture is desirable.

b. determining for incremental throttle settings through said selected motor speed range the minimum fuel flow required to propel the boat over a measured course in the minimum amount of time c. positioning said vacuum source orifice through the throat of the carburetor of the motor at a point near the peripheral edge of the throttle valve when said throttle valve is set to maintain the minimum RPM at said selected speed range d. connecting said vacuum source orifice by an open line to the air space above the fuel in the carburetor float bowl e. sizing said vent passage to atmosphere from the float bowl to reduce the pressure in said float bowl, and consequently reduce fuel flow, to that size most nearly equal to the minimum fuel flow determined as required in step (b).

13. In a carburetor for a two cycle engine, including a fuel float bowl, a nozzle feed well within said float bowl, a main nozzle and at least one idle jet communicating with said feed well, a restricted passage connecting said fuel bowl and well, an air inlet to said feed well above the fuel level therein and a butterfly type throttle valve, improved economizing means to reduce pressure within the float bowl of the carburetor and thereby fuel flow over a selected range of engine speed, comprising:

a small opening in the carbu retor throat upstream of the throttle valve, a first passage directly connecting said opening and the air chamber above the fuel in the float bowl, vent means communicating exclusively with one of said chamber and said first passage for venting said chamber to the atmosphere surrounding the carburetor at a point substantially free of influence of air flow into or through the carburetor, said first passage and opening in the carburetor throat having a restriction therein rendering said first passage substantially more restrictive to air flow than said vent, the range of locations of said opening being opposite the edge of the throttle butterfly valve when said valve is opened to between 5° and 20° from the fully closed position, so that said throttle valve and said opening cooperate to reduce pressure in said first passage and in said air chamber above the float bowl in inverse proportion to the distance of the nearest edge of said throttle valve to said opening.

14. In a two cycle engine including a carburetor having a fuel float bowl to supply a fuel/air mixture thereto, spark ignition means including control means for varying the timing of said spark, a throat and a throttle valve rotationally mounted in said throat, and means linking said throttle and spark control means for programmed relative movement of the same, and wherein the engine RPM advance over a selected mid-range is achieved by rotation of said throttle valve through a selected arcuate sector and substantial spark advance, means for reducing fuel consumption comprising:

a vacuum source including an aperture in the throat of said carburetor, a vent to atmosphere from the air space above the fuel in said float bowl, and passage means connecting said vacuum source and the aforesaid air space in the float bowl, said aperture being positioned adjacent the peripheral edge of said throttle valve at the outset of movement of said throttle valve through said selected arcuate sector, and said vent being very substantially larger in cross sectional area than said vacuum source aperture.

* * * * *